United States Patent [19]

Danaczko et al.

[11] Patent Number: 4,696,603

[45] Date of Patent: Sep. 29, 1987

[54] COMPLIANT OFFSHORE PLATFORM

[75] Inventors: Mark A. Danaczko; Lyle D. Finn; M. Sidney Glasscock; Michael P. Piazza; Kenneth M. Steele; Timothy O. Weaver, all of Houston, Tex.

[73] Assignee: Exxon Production Research Company, Houston, Tex.

[21] Appl. No.: 806,055

[22] Filed: Dec. 5, 1985

[51] Int. Cl.[4] ..... E02B 17/02

[52] U.S. Cl. ..... 405/227; 405/195; 405/224

[58] Field of Search ..... 405/202, 227, 195, 224, 405/203, 204

[56] References Cited

U.S. PATENT DOCUMENTS

| | | | |
|---|---|---|---|
| Re. 32,119 | 4/1986 | Abbott et al. | 405/227 |
| 3,389,562 | 6/1968 | Mott et al. | 405/227 X |
| 3,524,323 | 8/1970 | Miller | 405/202 |
| 3,636,716 | 1/1972 | Castellanos | 405/202 |
| 3,670,515 | 6/1972 | Lloyd | 405/202 |
| 3,677,016 | 7/1972 | Garrigus | 405/227 |
| 3,987,636 | 10/1976 | Hruska et al. | 405/227 X |
| 4,117,690 | 10/1978 | Besse | 405/227 |
| 4,363,567 | 12/1982 | ver der Graaf | 405/202 X |
| 4,378,179 | 3/1983 | Hasle | 405/227 |
| 4,417,831 | 11/1983 | Abbott et al. | 405/227 |
| 4,428,702 | 1/1984 | Abbott et al. | 405/202 |
| 4,576,523 | 3/1986 | Smetak | 405/227 |
| 4,599,014 | 7/1986 | McGillivray et al. | 405/225 |

FOREIGN PATENT DOCUMENTS

| | | | |
|---|---|---|---|
| 80352 | 8/1982 | Australia . | |
| 80353 | 8/1982 | Australia . | |
| 2123883 | 2/1984 | United Kingdom | 405/227 |
| 2147042A | 5/1985 | United Kingdom . | |

OTHER PUBLICATIONS

"A New Deep-Water Platform—The Guyed Tower"; Journal of Petroleum Technology; Apr. 1978, pp. 537–544.

"Compliant Jacket Challenges Deep Water with New Design"; Oil & Gas Journal; May 6, 1985; pp. 112–115.

*Primary Examiner*—Dennis L. Taylor

*Attorney, Agent, or Firm*—Richard F. Phillips

[57] ABSTRACT

A complaint offshore platform in which the primary restoring force to lateral displacement is established by flex piles driven into the seafloor and fixedly secured to the platform legs a preselected distance above the seafloor. The platform includes a substantially rigid space-frame structure extending from the ocean bottom to a position above the ocean surface. A drilling and production deck is secured atop the space-frame structure. Shear piles extend through the base of the space-frame structure to prevent lateral displacement of the base while permitting the space-frame structure to pivot about its base. As the platform sways about its base in response to environmental forces, the flex piles establish a vertical couple at the location at which they are attached to the space frame structure. This couple resists movement of the platform away from a vertical orientation. In the preferred embodiment, the flex piles are secured to the platform at or near one-half the total height of the space-frame structure.

42 Claims, 11 Drawing Figures

COMPLIANT OFFSHORE PLATFORM

FIELD OF THE INVENTION

The present invention generally concerns offshore structures adapted to have a compliant response to waves, wind and ocean currents. More specifically, the present invention concerns a compliant offshore drilling and production platform in which a vertical restoring couple is used to counter platform sway.

BACKGROUND OF THE INVENTION

Most offshore oil and gas production is conducted from platforms secured to the ocean bottom. A key design constraint for such platforms is that there be no substantial dynamic amplification of the platform's response to waves. This is accomplished by designing the platform to have natural vibrational periods which do not fall within that portion of the range of wave periods representing waves of significant energy. The several modes of platform vibration which are generally of greatest concern in platform design are pivotinf of the structure about the base (commonly termed "sway"), flexure ("bending") in the vertical plane, and torsion about the vertical axis. For most offshore locations the range of natural vibrational periods to be avoided is from 7 to 25 seconds, this representing the range of wave periods occurring with the greatest frequency.

For water depths up to about 300 meters, the technology for avoiding dynamic amplification of an offshore structure's wave response is quite well developed. Nearly all existing offshore structures designed for use in such water depths are fixedly secured to the ocean bottom and stiffened to cause each of the natural vibrational periods to be less than about 7 seconds. Such offshore structures are referred to as "rigid structures". However, as water depths exceed 300 meters, the tonnage of structural steel required to maintain sufficient platform rigidity to ensure that all natural vibrational periods remains below 7 seconds increases rapidly with depth. It has been suggested that for even the richest offshore oil fields the use of a rigid structure could not be economically justified in water depths exceeding about 420 meters due to the limitations imposed by the natural vibrational periods.

For deepwater applications, it has been proposed to depart from conventional rigid structure design and develop platforms having a sway period greater than the range of periods of ocean waves containing significant energy. Consequently, much of the environmental load imposed on the platform is resisted by its own inertia. Such platforms are termed "compliant structures." The use of a compliant platform effectively removes the upper bound on the sway period. This greatly reduces the increase in the structural steel, and hence cost, required for a given increase in water depth.

In one type of compliant structure, the guyed tower, the platform deck is supported on a slender space-frame structure extending from the ocean bottom to the ocean surface. A radially arranged set of guylines extend outward from an upper portion of the space-frame structure to the ocean bottom. These guylines provide a restoring force to counter platform sway induced by environmental forces. Guyed towers are disadvantageous in that the guyline system is expensive to fabricate and deploy. In certain applications the guylines may also present an obstacle to navigation and fishing in the vicinity of the platform.

A second type of compliant structure, the tension leg platform, uses buoyancy to provide a restoring force to resist the platform's lateral displacement. The deck of the tension leg platform is situated on a large buoyant hull which is secured to a foundation at the ocean bottom by a set of vertical tethers. The tethers are tensioned and hence maintain the hull at a deeper draft than it would assume if floating free. When the hull is displaced laterally by environmental forces, the net vertical buoyant force acting on the tethers produces a righting moment tending to restore the hull to its original vertical position.

A significant drawback of the tension leg platform is that its buoyancy requirements are great. This necessitates use of a large and expensive hull structure. This is undesirable in that it increases the cross sectional area of the structure exposed to wind, waves, and current. Additionally, the production wells system for a tension leg platform is substantially more complex than that required for a traditional rigid structure. Further, for use in water depths greater than about 600 meters it is highly desirable to provide the tethers with inherent buoyancy to minimize the loading the tethers impose on the hull. This presents numerous technical problems.

It would be desirable to develop a compliant tower which does not rely primarily on guylines or positive buoyancy to counter lateral displacement caused by environmental forces.

SUMMARY OF THE INVENTION

The present invention is directed to a compliant offshore platform in which platform sway is resisted by a vertical couple established by a set of flex piles. In the preferred embodiment, the platform includes a rigid space-frame structure having a base resting on the ocean bottom and extending upward to an upper portion positioned 15–30 meters above the ocean surface. A drilling and production deck is situated atop the space-frame structure. A set of shear piles prevents lateral displacement of the space-frame structure base, while permitting the space-frame structure to pivot about the ocean bottom in response to waves and other environmental forces. A plurality of flex piles are driven into the ocean bottom at preselected locations around the periphery of the platform. Each of these flex piles extends upward along a corresponding leg of the space-frame structure to a preselected elevation below the wave zone, where it is secured to the platform. In the preferred embodiment, the flex pile attachment location is at or near one-half the total height of the space-frame structure.

The flex piles provide substantially all of the platform's resistance to sway induced by environmental forces. Guylines are not required. As the platform sways, the flex piles attached to that side of the platform away from the direction of platform tilt are placed in tension, while the flex piles on the opposite side of the platform are placed in compression. Thus, the flex piles establish a restoring couple at the point of attachment to the space-frame structure which limits the magnitude of platform sway resulting from environmental forces. The stiffness, number and location of the flex piles are selected to yield a sway period of greater than 25 seconds. This is sufficiently great to ensure that there is no substantial dynamic amplification of the platform's response to waves.

BRIEF DESCRIPTION OF THE DRAWINGS

For a better understanding of the present invention, reference may be made to the accompanying drawings, in which.

These drawings are not intended as a definition of the invention, but are provided solely for the purpose of illustrating certain preferred embodiments of the invention, as described below.

DESCRIPTION OF THE PREFERRED EMBODIMENTS

Figure 1:
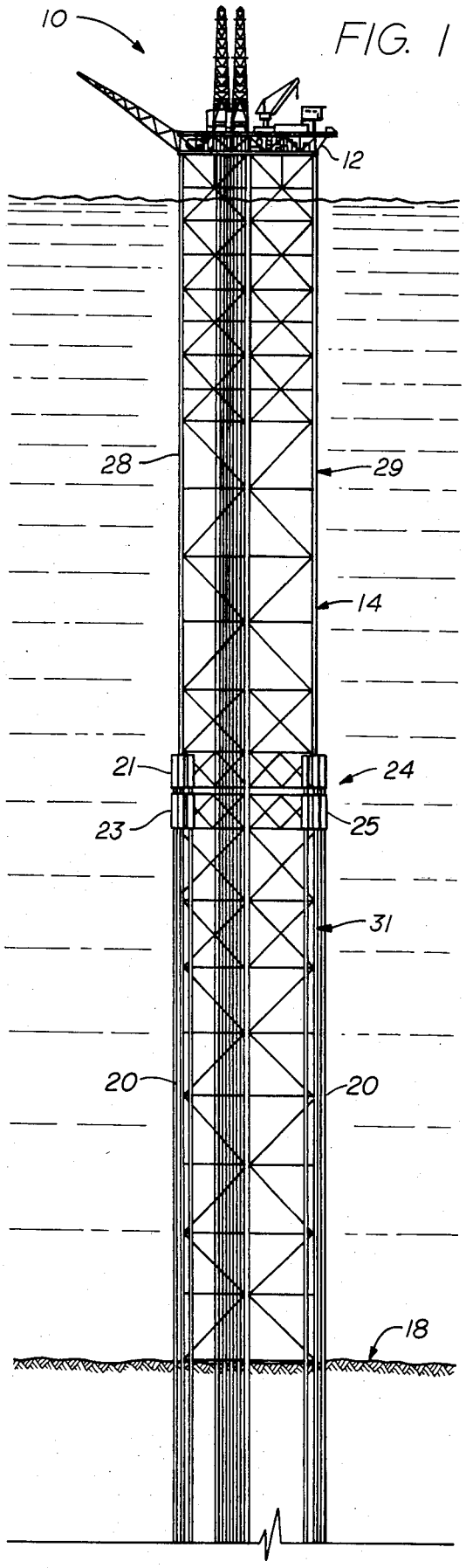
FIG. 1 is an elevational view of an offshore platform incorporating the present invention.
Figure 2:
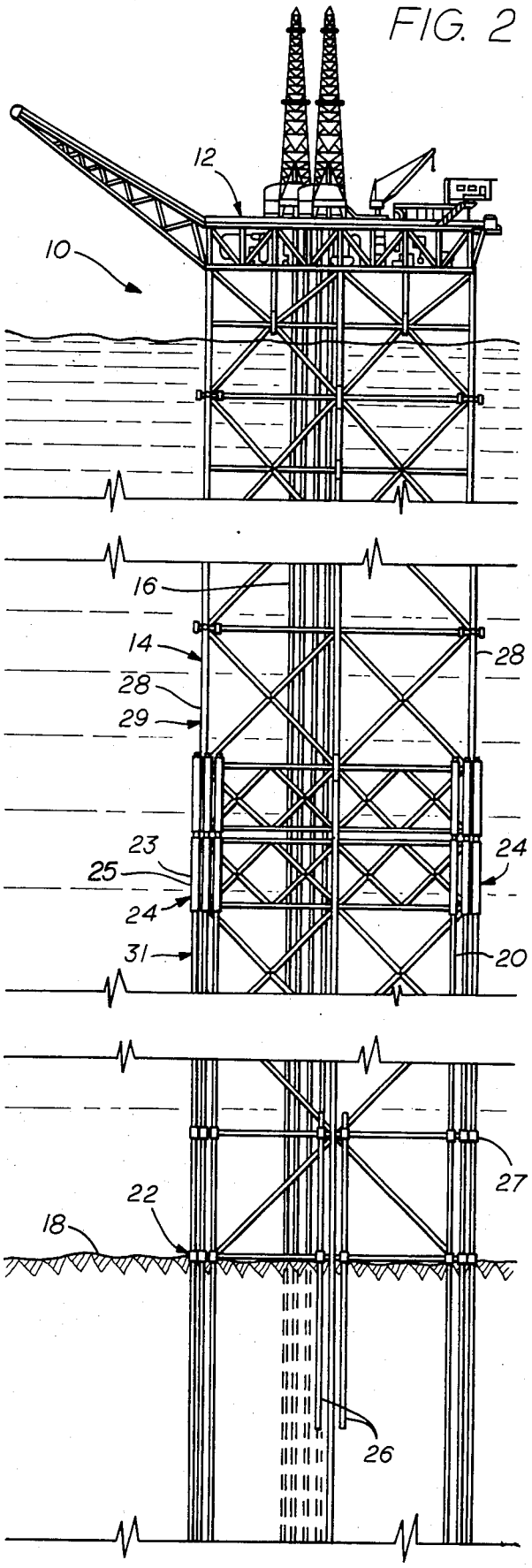
FIG. 2 is an enlarged view of portions of the platform shown in FIG. 1.

FIGS. 1 and 2 show an elevational view of a preferred embodiment of the compliant offshore platform 10 of the present invention. As will become apparent in view of the following discussion, the preferred embodiment of the compliant offshore platform 10 is adapted for use as an oil and gas drilling and production platform. However, the present invention can also be used for a variety of other purposes. To the extent that the following discussion is specific to drilling and production platforms, this is by way of illustration rather than limitation.

In the preferred embodiment, the compliant offshore platform 10 includes a drilling and production deck 12 situated atop a slender space-frame structure 14. The space-frame structure 14 is constructed of tubular steel in a manner well known to those skilled in the art. The space-frame structure 14 should be substantially rigid, having a natural bending period (flexure period) less than about 7 seconds. Drilling and production are performed through conductors 16 extending from the deck 12 to the ocean bottom 18. The conductors 16 are preferably situated proximate the central longitudinal axis of the platform 10. In certain embodiments it is desirable to rigidly secure the conductors 16 to the deck 12, permitting the conductors 16 to flex in response to platform sway. Placing the conductors 16 near the platform's longitudinal axis minimizes this flexing.

The legs 28 and other tubular components of the space-frame structure 14 are sealed to avoid being flooded with seawater upon platform installation. This decreases the in-water weight of the platform 10. In the preferred embodiments of this invention, the space-frame structure 14 and deck 12 together have a net negative buoyancy. As will be described below, the requisite degree of platform compliancy is obtained without the need for special buoyancy chambers.

Platform sway (substantially rigid rotation about the platform base) is resisted by tubular steel flex piles 20 driven into the soil surrounding the base 22 of the platform. The flex piles 20 extend upward to a flex pile connector 25 situated at preselected pile attachment location 24 on the periphery of the space-frame structure 14. At the pile attachment location 24, the flex piles 20 are welded, grouted or otherwise rigidly connected to the space-frame structure 14. In addition to resisting platform sway, the flex piles 20 also support a portion of the weight of the platform 10 and transmit lateral forces to the soil. In some embodiments shear piles 26 may be driven through the platform base 22 to provide additional resistance against lateral deflection of the platform base 22. The shear piles 26 are not grouted to the platform base 22 and accordingly do not restrain vertical motion of any portion of the platform base 22. Because the space-frame structure 14 is substantially rigid, lateral deflection of the upper portion of the platform 10 in response to waves and other environmental forces causes the space-frame structure 14 to pivot about the ocean bottom 18. This pivoting occurs about a horizontal pivot axis at or near the ocean bottom 18. This axis passes approximately through the geometric center of the platform base 22 and is orthogonal to the direction of platform motion.

As the platform 10 pivots, that portion of the platform base 22 away from the direction of platform deflection moves upward from the ocean bottom 18 an amount proportional to the magnitude of the deflection. The opposite portion of the platform base 22 moves downward into the ocean bottom 18 an equal amount. Accordingly, the flex piles 20 on that side of the platform 10 away from the direction of deflection are placed in tension while the flex piles 20 on the opposite side the platform 10 are placed in compression. This establishes a vertical couple acting at the pile attachment location 24 tending to resist further lateral deflection and restore the platform 10 to its initial vertical position. Buckling of the flex piles 20 as they are placed in compression is prevented by pile guides 27 secured to the space-frame structure 14.

The magnitude of the vertical couple for a given degree of platform deflection is a function of the length, cross sectional area, number, and composition of the flex piles 20 and the lateral distance from the pivot axis to the point at which each pile enters the ocean bottom. The magnitude of the vertical restoring couple as a function of platform sway should be established to cause the platform 10 to have a sway period exceeding 25 seconds.

The embodiment of the compliant offshore platform 10 shown in FIGS. 1 and 2 is designed for use in a water depth of 790 meters under Gulf of Mexico environmental conditions. The platform 10 has nine main legs 28 arranged in a 3×3 square array, 73 meters on a side. Each of the legs 28 is 1.83 meters in diameter and has a maximum wall thickness of 7.0 cm. Four flex piles 20 surround each of the corner legs 28. The flex piles 20 are 1.37 meters in diameter, have a thickness of 5.7 cm. and are grouted to the legs 28 at a location 440 meters above the ocean bottom 18. File guides 27 are provided every 36 meters along the length of each flex pile 20. Two shear piles 26 are driven adjacent each of the middle legs 28 along the periphery of the platform base 22. The weights of the space-frame structure 14, pile system and topsides are, respectively, 39,000 metric tons, 18,120 metric tons and 13,600 metric tons. During the design one-hundred year storm, the maximum deck offset from the vertical is 9.1 meters, the maximum platform tilt is 0.7° and the maximum platform twist is 0.1°. The platform 10 has a sway period of 37 seconds and natural periods of bending and torsion of 6.8 and 5.8 seconds, respectively.

Figure 3:
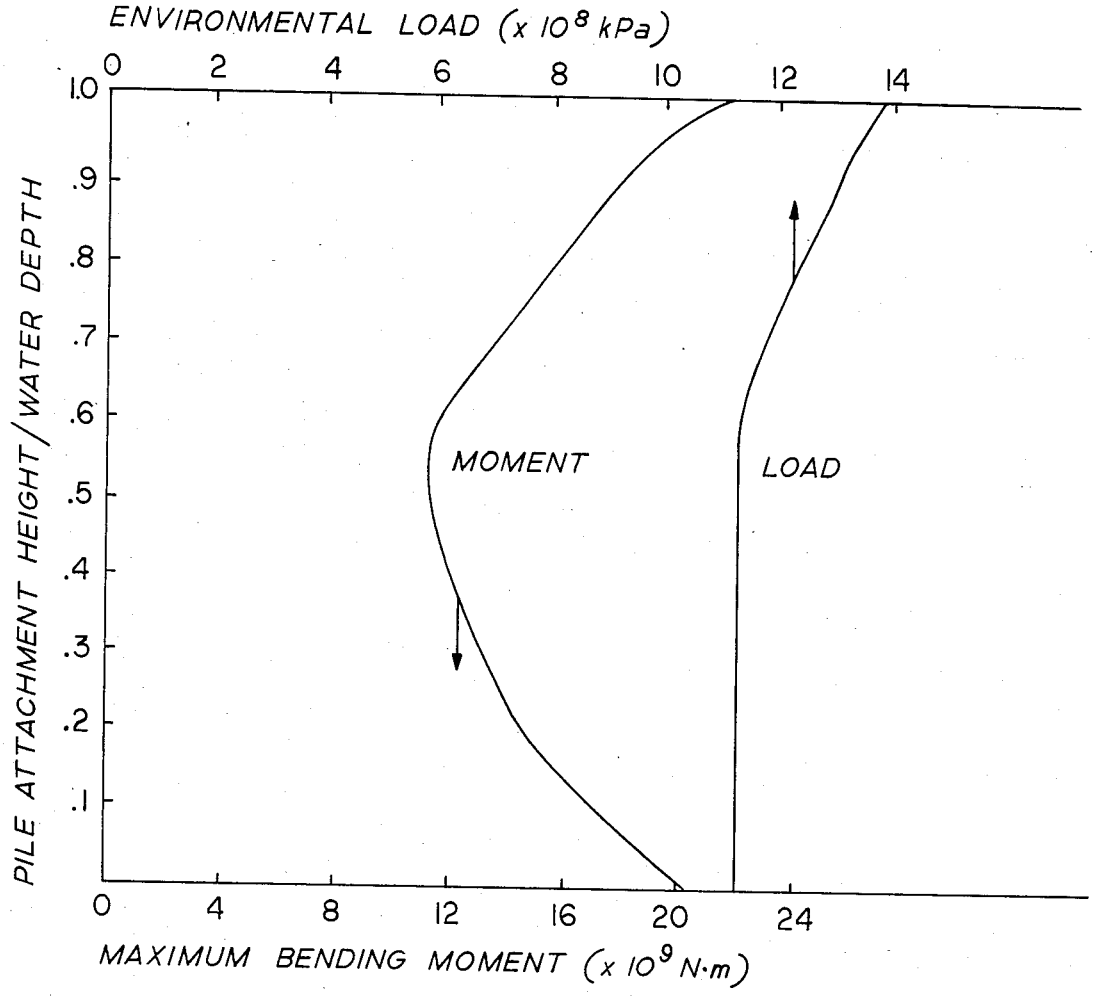
FIG. 3 is a graph illustrating the bending moment and environmental loading for the compliant offshore platform of the present invention as a function of the location of the attachment of the piles to the structure.

We have discovered that it is highly desirable to avoid placing the pile attachment location 24 at or near the platform deck 12. The position of the pile attachment location 24 should be selected on the basis of minimizing the internal moment of the platform 10 in response to anticipated environmental loading. By minimizing the internal moment which the platform 10 must resist, it is possible to use a lighter and less expensive space-frame structure 14 than would otherwise be necessary. FIG. 3 is a graph showing the maximum bending moment and total environmental load on a 300 meter compliant offshore structure as a function of the elevation of the pile connection location. The maximum bending moment reaches its minimum value when the pile connection location is established at approximately one-half the total elevation of the space-frame structure 14. This result is substantially independent of the specific configuration of the space-frame structure 14 and is also substantially independent of water depth.

Figure 4:
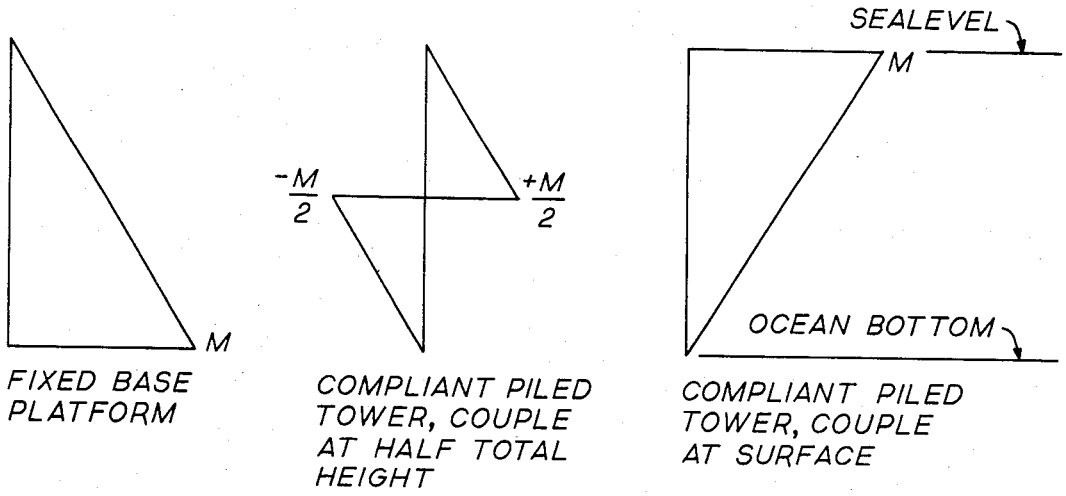
FIG. 4 is a comparison of the bending moment diagrams for a traditional fixed base jacket, a compliant offshore platform having its flex piles secured at the ocean surface, and a compliant offshore platform having its flex piles secured at one-half the platform height.

FIG. 4 compares the moment diagram for a compliant offshore platform with the flex piles secured at one-half the platform height to corresponding moment diagrams for a traditional fixed base jacket and a compliant offshore platform with the flex piles tied to the space-frame structure 14 at the ocean surface. The fixed base jacket must have a bending resistance sufficient to support a linearly increasing unidirectional moment. As can readily be seen in FIG. 4, the restoring moment of the compliant offshore platform 10 with the flex piles tied at one-half the total height of the platform results in a reduction in the absolute magnitude of the bending moment by dividing the moment into positive and negative components. Accordingly, the maximum single amplitude value of the bending moment which must be resisted by the space-frame structure is greatly reduced, allowing use of a structure which requires less structural steel than alternate platform configurations. The reduction in the internal moment which must be carried by the space-frame structure is made possible by transferring a portion of the moment to the flex piles 20. This is desirable since piles are far less susceptible to fatigue damage than the tubular connections of a space-frame structure. Additionally, on a per unit weight basis, the complexity and expense of fabricating piles is much less than that for space-frame structures.

A further advantage of placing the pile attachment location at one-half the total elevation of the platform is that this causes the location of the maximum bending moment to coincide with that portion of the platform at which additional stiffness is most effective in reducing the bending period. Accordingly, in the preferred embodiment shown in FIG. 1, the additional cross bracing at the pile attachment location 24 provides resistance to the greatest bending moment experienced by the space-frame structure 14 and is also placed to cause the greatest possible reduction in the bending period.

Another advantage of placing the pile attachment location at or near the midpoint of the platform height is that the total environmental load on the platform 10 is significantly decreased. As best shown in FIG. 2 the flex piles 20 represent a significant fraction of the total vertical cross-section of the platform 10. By placing the flex piles 20 below the wave zone the effective cross section of the platform 10 to environmental loading is significantly reduced, resulting in a significant decrease in total platform loading. This is illustrated in FIG. 3. Additionally, it is desirable to decrease the total length of the piles used in the platform 10 to minimize the fabrication and installation expense.

In the preferred embodiment of the present invention, the space-frame structure 14 is fabricated in separate upper and lower sections 29,31 of approximately equal length. This significantly decreases the complexity and cost of platform installation and fabrication. In platform installation the two sections 29,31 of the space-frame structure 14 are launched from separate barges. The legs 28 of each section 29,31 are capped and filled with air to have a net positive buoyancy. While floating, the sections 29,31 are aligned and temporarily locked together with mechanical connectors. The space-frame structure 14 is then positioned over the installation site, upended and set on the ocean bottom. As best shown in FIG. 2, the flex piles 20 supporting the platform 10 are each driven through corresponding upper and lower pile connection sleeves 21,23. These sleeves are secured, respectively, to the platform legs 26 at the lowermost portion of the upper section 29 and the uppermost portion of the lower section 31. The flex piles 20 are then grouted or otherwise permanently secured to both sleeves 21,23. This arrangement serves both to permanently join the upper and lower sections 29,31 of the space-frame structure 14 and to provide the necessary pile-platform connection.

It is critical to ensure that the stress imposed on the flex piles 20 under maximum lateral deflection of the platform 10 does not cause plastic deformation of the piles or failure of the ocean bottom soil in which the piles 20 are set. In the embodiment shown in FIGS. 1 and 2, the greatest design stress imposed on the flex piles 20 occurs when platform deflection occurs along a diagonal of the platform cross section during the design one-hundred year storm. This yields a maximum platform deflection of 0.7°, which causes the piles in the direction of platform tilt to be compressed a total of 59 cm., while the piles away from the direction of platform tilt elongate a like amount. The set of piles receiving the greatest design stress are those surrounding the leg which is in the direction of platform tilt. The total stress is $1.83\times10^5$ kPa ($26.6\times10^3$ psi), of which $1.49\times10^5$ kPa ($21.6\times10^3$ psi) results from tilt induced pile compression and $3.4\times10^4$ kPa ($5.0\times10^3$ psi) is due to the portion of the platform weight supported by the piles. This total stress is 76% of the maximum buckling stress of $2.4\times10^5$ kPa. The tensioned set of flex piles surrounding the leg away from the direction of tilt is under a smaller load due to the initial compressive loading resulting from the weight of the platform. In many applications, the limiting pile stress occurs in driving the pile. This imposes a minimum pile wall thickness dependent on the nature of the ocean bottom soil through which the pile is driven. This minimum wall thickness may be greater than that necessary to accommodate the maximum degree of pile compression/extension in the course of platform sway. To overcome this limitation it may be desirable to employ piles having a relatively thick-wall section which is driven into the ocean bottom 18 and a relatively thin-wall portion extending upward from the ocean bottom 18 to the pile attachment location 24.

Clearly, there is a minimum pile length which will provide the necessary platform compliancy for a given set of design conditions without imposing an unsafe pile stress or causing soil failure. The minimum pile length cannot be reduced simply by increasing the number of piles or increasing the cross section of each pile because this would decrease the platform compliancy. For a platform having the relative proportions and pile-leg configuration shown in FIGS. 1 and 2, the minimum pile length necessary to maintain an acceptable degree of compliancy is about 440 meters for Gulf of Mexico conditions and 760 meters for North Sea conditions.

One solution to this problem is to shift the location at which the flex piles 20 enter the ocean bottom 18 to a position nearer the centerpoint of the platform base 22. This results in a decrease in pile elongation/compression, and hence pile stress, for a given degree of platform deflection. Of course, it would be necessary to increase the number or cross-section of the piles in proportion to the decrease in pile stress to maintain the necessary magnitude of the vertical restoring couple.

Figure 7:
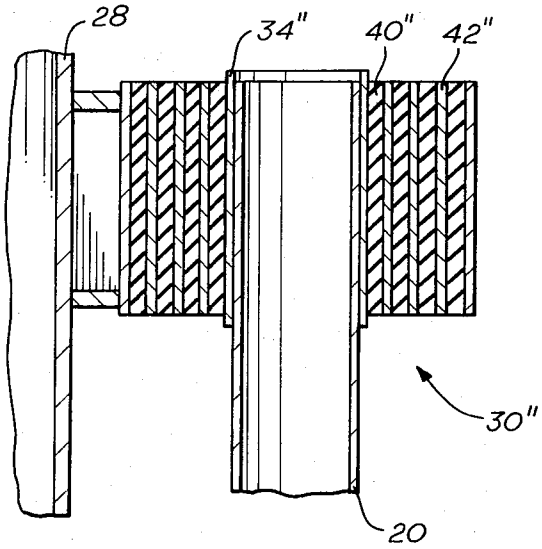
FIGS. 5–7 show resilient connectors useful in alternate embodiments of the present invention.
Figure 6:
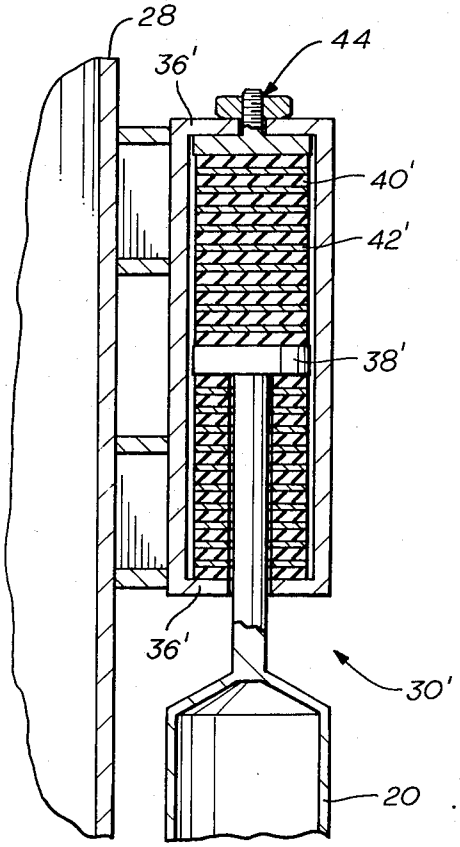
Figure 5:
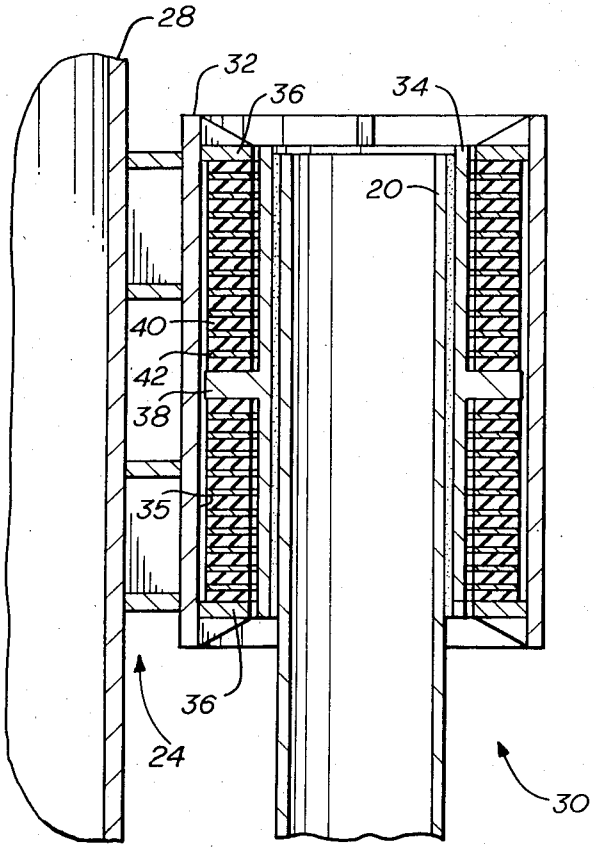

Another manner of reducing the minimum pile length is to place a resilient connector between the platform 10 and the pile 20. This resilient connector 30 preferably takes the form of an elastomeric spring as shown in FIGS. 5–7. In the embodiment shown in FIG. 5, the resilient connector 30 is contained within a housing 32 rigidly secured to the platform 10 at the desired pile attachment location 24. Concentric with and interior to the housing 32 is a sleeve 34 through which the flex pile 20 is driven. The pile 20 is welded, grouted or otherwise rigidly connected to the sleeve 34. The sleeve 34 and housing 32 define an annular spring containment space 35 bounded at its upper and lower ends by reaction members 36 fixed to the housing 32. An annular piston 38 secured to the pile connection sleeve 34 extends into the spring containment space 35 intermediate the upper and lower reaction members 36. A stack of thin annular elastomeric spring elements 40 occupy the spring containment space 35. The spring elements 40 are separated one from the other by steel plates 42 to control the deformation of the spring elements 40 as they are placed in compression.

Operation of the resilient connection 30 occurs as follows. When the platform 10 tilts away from the pile 20 the housing 32 moves upward relative to the pile 20, placing the elastomeric elements 40 intermediate the annular piston 38 and lower reaction member 36 in compression. When the platform 10 tilts toward the pile 20, the upper set of elastomeric elements 40 are placed in compression. The resilient connection 30 should be configured so that in conjuction with the pile 20 it provides load-deflection characteristics appropriate to provide the desired maximum lateral platform deflection and natural sway period in response to the environmental conditions of the platform installation site. Stiffness of the resilient connection 30 is controlled both by the modulus of elasticity of the material from which the spring elements 40 are composed and the radial cross-sectional area of the individual spring elements 40. The maximum allowable deflection is controlled by the total thickness of the spring elements 40. For most elastomeric materials total spring compressive deformation should be limited to 10% of the unstressed thickness of the material in compression to avoid plastic deformation or other undesirable load-deformation behavior. In the ideal configuration, the combination of the resilient connector 30 and the flex pile 20 provides load-deflection characteristics equivalent to those yielded by use of a longer pile.

The resilient connector 30 could assume many other embodiments. FIG. 6 shows an elastomeric spring having a threaded preload mechanism. This preload mechanism 44 permits adjustment for material relaxation and creep and also prevents the piston 38 from separating from the elastromeric elements 40 when they are unloaded. Separation of the unloaded elastomeric elements 40 could also be prevented by bonding all of the elastomeric elements 40 and steel plates 42 together so that the elastomeric elements 40 could also act in tension. FIG. 7 shows an elastomeric spring in which the individual elastomeric elements 40 and steel plates 42 are bonded together with the spring being adapted to act in shear rather than compression. Those skilled in the art will recognize that the resilient connector 30 need not include an elastromeric spring. Metallic and hydraulic springs could be used instead.

Figure 8:
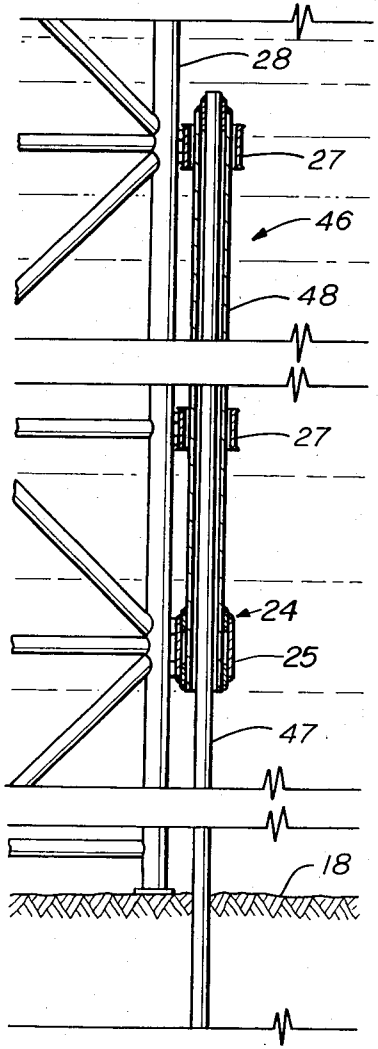
FIG. 8 shows a telescoped pile adapted for use with the present invention.

Another alternative for platforms situated in water depths too shallow to avoid overstressing a standard tubular pile is to use a telescoped pile 46, as shown in FIG. 8. A complete description of telescoped piles is provided in U.S. Pat. No. 4,378,179, issued Mar. 29, 1983. As used in conjunction with the compliant platform 10 of the present invention, the telescoped piles 46 include a standard tubular pile element 47 driven into the ocean bottom 18 and extending upward to a position above the pile attachment location 24. A tubular pile sleeve 48 is concentric with and fixedly secured to the upper end of the tubular pile element 47. The pile sleeve 48 extends downward through pile guides 27 to the pile attachment location 24 where it is fixedly secured to the space-frame structure 14. The use of the telescoped pile 46 yields a pile having an effective length equal to the length of the pile element 47 plus the length of the pile sleeve 48. Thus, for a platform 10 in a 300 meter water depth with a desired pile attachment location of 150 meters, the use of telescoped pile 46 extending to the ocean surface yields an effective pile length of 450 meters.

Figure 10:
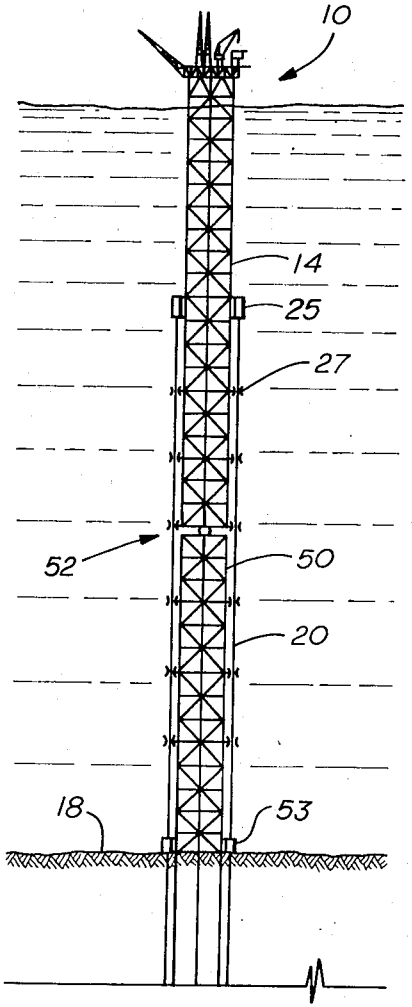
FIG. 10 is an elevational view of a second alternate embodiment of the present invention in which a fixed base is used.
Figure 9:
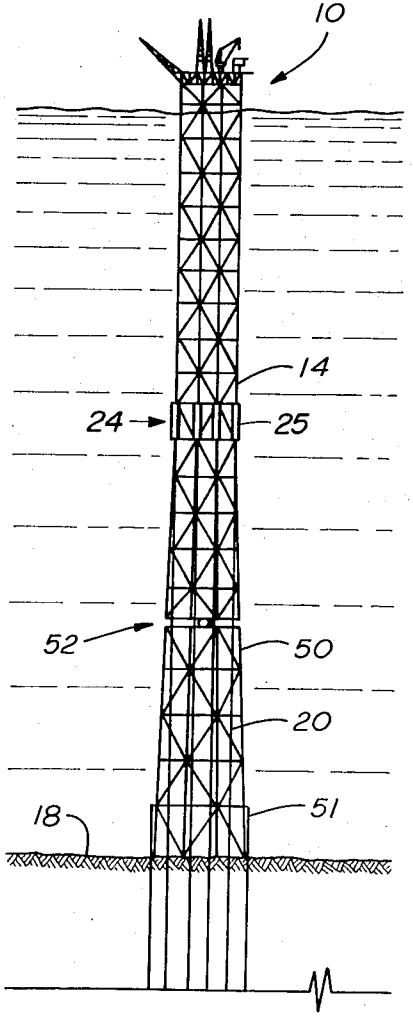
FIG. 9 is an elevational view of an alternate embodiment of the present invention in which a fixed base is used.

Shown in FIGS. 9 and 10 are alternate embodiments of the present invention adapted for use in relatively deep water applications. In these embodiments the space-frame structure 14 is situated atop a fixed base segment 50. The space-frame structure 14 is secured to the fixed base segment 50 by a structural pivot joint 52 which is adapted to resist shear loads and torsional moments. A suitable pivot joint 52 is detailed in copending U.S. patent application Ser. No. 756,405, filed July 17, 1985. The base segment 50 is adapted to remain substantially free from tilting and bending, and hence serves as a fixed foundation about which the space-frame structure 14 pivots. FIG. 9 illustrates the base segment 50 as a battered space-frame structure fixed securely to the ocean bottom 18 by skirt piles 51 which are rigidly secured to the base segment 50. Alternately, the base segment 50 could be a conventional gravity structure or, as shown in FIG. 10, a space-frame structure with the flex piles 20 grouted or otherwise mechanically connected to sleeves 53 in its base to resist tilting.

As in the previous embodiments, the flex piles 20 extend upward through pile guides 27 and are secured to the space-frame structure 14 by pile connectors 23.

Figure 11:
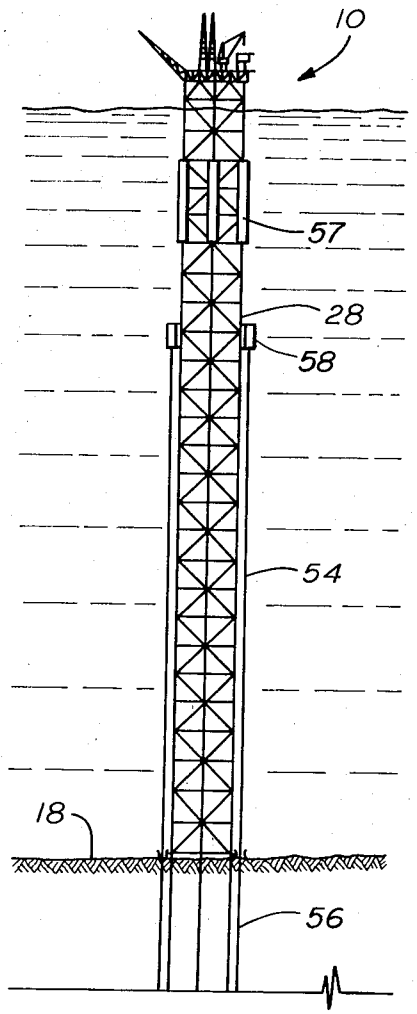
FIG. 11 is an elevational view of an embodiment of the present invention in which tensioned cables rather than piles provide the restoring vertical couple against lateral deflection.

In another alternate embodiment, shown in FIG. 11, cables at 54 are used in place of piles 20, Each cable 54 extends along the outer surface of the space-frame structure 14 from an anchor pile 56 to a cable connector 58 secured to the space-frame structure at the elevation at which the vertical restoring couple is to be applied. Alternately, the cables 54 could be run through the legs 28 of the platform 10. To reduce the possibility of snap loading the cables 54, it is important to prevent the cables 54 from going slack under extreme lateral displacement. This is accomplished by pretensioning the cables 50. In certain applications it may be desirable to have the cables extend from the ocean bottom 18 to a cable connection elevation at the ocean surface or deck. Buoyancy modules 57 are provided to offset the compressive loading imposed on the space-frame structure 14 by the tensioned cables 50.

The preferred embodiment of the present invention and the preferred methods of using it have been detailed above. It should be understood that the foregoing description is illustrative, and that other embodiments of the invention can be employed without departing from the full scope of the invention as set forth in the appended claims.

What we claim is:

1. A compliant offshore platform for use in hydrocarbon drilling and producing operations, comprising:

a deck;

a substantially rigid vertical tower adapted to support said deck above the ocean surface, said tower having a base and being adapted to pivot relative to the ocean floor about its base in response to the action of waves, the combination of said deck and tower having a net negative buoyancy and being free from guyline support; and means for applying a vertical couple to said tower in response to pivoting of said tower, said couple being applied at a position on said tower intermediate said tower base and the bottom of the wave zone of the ocean environment in which said tower is situated, said vertical couple tending to resist sway of the tower away from the vertical.

2. The compliant offshore platform as set forth in claim 1 wherein said vertical couple is applied at a position proximate one-half the total height of said tower.

3. The compliant offshore platform as set forth in claim 1 wherein said couple applying means includes a plurality of piles set into the ocean bottom and extending upward to a location intermediate said tower base and the bottom of the zone, at which location each of said piles is secured to said tower.

4. The compliant offshore platform as set forth in claim 3 wherein said tower includes a plurality of vertically oriented legs extending the length of the tower along its periphery, said piles each extending substantially parallel to said legs and being secured to a selected one of said legs.

5. The compliant offshore platform as set forth in claim 4 wherein a resilient connector is used to secure each of said piles to the corresponding one of said legs.

6. The compliant offshore platform as set forth in claim 4 wherein said tower base rests on the ocean bottom.

7. The compliant offshore platform as set forth in claim 4 further including a fixed base segment rigidly secured to the ocean bottom, said tower being pivotably connected atop said fixed base segment.

8. The compliant offshore platform as set forth in claim 1 wherein said couple applying means includes a plurality of vertically oriented, tensioned cables each having a first end secured to the ocean bottom and having a second end secured to said tower at a location intermediate said tower base and the bottom of the ocean wave zone whereby sway of said tower serves to place those cables away from the direction of sway into increased tension and place those cables toward the direction of sway into reduced tension whereby a differential movement is applied to said tower by said cables establishing said vertical couple.

9. The compliant offshore platform as set forth in claim 8 further including buoyancy modules secured to said tower to relieve at least a portion of the compressive loading imposed on said tower by the tensioned cables.

10. A compliant offshore platform not requiring guylines to resist lateral motion resulting from wave action, comprising:

a deck;

a vertically oriented space-frame structure adapted to support said deck a preselected distance above the ocean surface, said space-frame structure having a plurality of legs extending the length of the space-frame structure from said deck downward to a space-frame structure base portion situated at a preselected location below the ocean surface, the combination of said deck and space-frame structure having a net negative buoyancy and being adapted to pivot about said base portion in response to wave action; and a plurality of piles set into the ocean bottom, each of said piles extending upward along said space-frame structure and being fixedly secured to said space-frame structure at a pile attachment elevation intermediate said base portion and the bottom of the wave zone of the ocean environment in which said offshore platform is located, whereby in response to said space-frame structure swaying away from a vertical orientation said piles establish a vertical restoring couple acting at said pile attachment elevation, said piles being configured and situated to cause said compliant offshore platform to have a sway period exceeding 25 seconds.

11. The compliant offshore platform as set forth in claim 10 wherein said pile attachment elevation is situated proximate one-half the total height of said tower.

12. The compliant offshore platform as set forth in claim 10, wherein said space-frame structure base portion rests on the ocean bottom, said base portion being free to pivot about said ocean bottom.

13. The compliant offshore platform as set forth in claim 10, further including a fixed base segment rigidly secured to the ocean bottom, said space-frame structure being pivotably connected atop said fixed base segment.

14. The compliant offshore platform as set forth in claim 10 wherein at least some of said legs extend upward along the periphery of said space-frame structure and wherein each of said piles extends upward along the periphery of said space-frame structure adjacent a corresponding one of said leg, said piles each being rigidly secured to the corresponding one of said legs at said pile attachment elevation.

15. The compliant offshore platform as set forth in claim 10 wherein said space-frame structure defines a square in horizontal cross section, four of said legs defining the corners of said square, each of said four legs having a plurality of said piles extending upward adjacent it and rigidly secured to it at said pile attachment elevation.

16. The compliant offshore platform as set forth in claim 10 wherein said space-frame structure defines a hexagon in horizontal cross section, six of said legs defining the corners of said hexagon, each of said six legs having a plurality of said piles extending upward adjacent it and rigidly secured to it at said pile attachment elevation.

17. The compliant offshore platform as set forth in claim 10 wherein said space-frame structure defines a octagon in horizontal cross section, eight of said legs defining the corners of said octagon, each of said eight legs having a plurality of said piles extending upward adjacent it and rigidly secured to it at said pile attachment elevation.

18. The compliant offshore platform as set forth in claim 12 wherein said piles are telescoped piles.

19. The compliant offshore platform as set forth in claim 12 wherein a pile connector is used to secure each of said piles to said structure at said pile attachment elevation.

20. The compliant offshore platform as set forth in claim 19 wherein said pile connectors each includes a sleeve rigidly secured to a platform leg, each of said piles extending upward from said ocean bottom into a corresponding one of said sleeves and being rigidly secured therein.

21. The compliant offshore platform as set forth in claim 19, wherein said pile connectors are each adapted to establish a resilient connection between the space-frame structure and the pile associated with said connector.

22. The compliant offshore platform as set forth in claim 21, wherein said pile connector includes an elastomeric spring.

23. The compliant offshore platform as set forth in claim 22 wherein said pile connector includes a first reaction member rigidly secured to said pile and a second reaction member rigidly secured to said space-frame structure, said first and second reaction members extending substantially transverse to the longitudinal axis of said pile and being vertically spaced one from the other, an elastomeric material being interposed between said first and second reaction members whereby a decrease in the spacing between said first and second reaction members occurring in the course of platform sway is resiliently resisted by compression of said elastomeric material.

24. The compliant offshore platform as set forth in claim 23 further including an elastomeric spring housing rigidly secured to said space-frame structure, said second reaction member being rigidly secured to said housing, said first reaction member being situated within said housing.

25. The compliant offshore platform as set forth in claim 24 wherein said housing is a vertically oriented cylinder and said pile extends into said housing, said first reaction member extending laterally outward from said pile to a position proximate the inside diameter of said housing, there being two second reaction members secured to said housing, one vertically above and one vertically below said first reaction member, there being elastomeric material interposed between said first reaction member and each of said second reaction members.

26. A compliant offshore platform for use in hydrocarbon drilling and producing operations, comprising:

a deck;

a space-frame structure adapted to support said deck a preselected distance above the ocean surface, said space-frame structure having a lower section and an upper section, the combination of said deck and space-frame structure having a net negative buoyancy and being adapted to pivot about the lowermost portion of said space-frame structure in response to the action of waves;

a plurality of first and second pile connection sleeves, each first pile connection sleeve being secured to the lower portion of said upper space-frame structure section and each second pile connection sleeve being secured to the upper portion of said lower space-frame structure section, said first and second pile connection sleeves being arranged in spaced apart, coaxial pairs; and a plurality of piles, each pile being set an effective distance into the ocean bottom and extending upward through a corresponding pile connection sleeve pair, each of said piles being fixedly secured within both of the corresponding pile connection sleeves, whereby said upper and lower sections of said space-frame structure are permanently joined together and whereby said piles impose a vertical restoring couple on said structure in response to platform sway.

27. The compliant offshore platform as set forth in claim 26 wherein said platform is free from guylines.

28. The compliant offshore platform as set forth in claim 27 wherein said lower and upper sections of said space-frame structure are substantially equal in length.

29. The compliant offshore platform as set forth in claim 27 wherein said space-frame structure rests upon the ocean bottom.

30. The compliant offshore platform as set forth in claim 27 wherein said space-frame structure is supported upon a non-compliant base segment.

31. The compliant offshore platform as set forth in claim 30 wherein said base segment is a second space-frame structure rigidly secured to the ocean bottom.

32. A compliant offshore structure comprising:

a deck;

a substantially rigid vertical tower adapted to support said deck, said tower having a base, said tower being adapted to pivot relative to the ocean floor about said base in response to the action of waves, the combination of said deck and tower having a net negative buoyancy and being free from laterally extending guylines adapted to provide stabilization against lateral sway; and a plurality of piles set into the ocean bottom, each of said piles extending upward to a tower pile attachment location corresponding to said pile, said pile attachment location being located distal from said ocean bottom and below the wave zone of the ocean environment in which said tower is situated, said pile being rigidly secured to said tower at said pile attachment location and being free from rigid attachment to said tower below said pile attachment location, whereby in response to pivoting of said tower, the portion of said pile intermediate said ocean bottom and said pile attachment location compliantly resists pivoting of said tower.

33. The compliant offshore platform as set forth in claim 32 wherein said pile attachment elevation is situated proximate one-half the total height of said tower.

34. The compliant offshore platform as set forth in claim 32, wherein said space-frame structure base portion rests on the ocean bottom, said base portion being free to pivot about said ocean bottom.

35. The compliant offshore platform as set forth in claim 32, further including a fixed base segment rigidly secured to the ocean bottom, said space-frame structure being pivotably connected atop said fixed base segment.

36. The compliant offshore platform as set forth in claim 35 wherein said piles are telescoped piles.

37. A compliant offshore structure comprising:

a deck;

a substantially rigid vertical tower adapted to support said deck, said tower having a base, said tower being adapted to pivot relative to the ocean floor about said base in response to the action of waves, the combination of said deck and tower having a net negative buoyance, said tower and deck being free from guylines adapted to provide stabilization against lateral sway of said tower; and a plurality of piles set into the ocean bottom, each of said piles being fixedly secured to said tower at a corresponding pile attachment location, said pile attachment locations being located below the wave zone of the marine environment in which said tower is situated, said piles each extending a preselected distance intermediate said ocean bottom and said pile attachment location, said piles each being free from fixed attachment to said tower along said preselected distance, whereby in response to pivoting of said tower, the portion of each pile extending along said preselected distance compliantly resists pivoting of said tower.

38. The compliant offshore structure as set forth in claim 37 wherein at least some of said piles are telescoping piles having pile attachment locations at a position on said tower proximate said tower base.

39. A compliant offshore platform comprising:

a deck;

a space frame structure having a base resting on the ocean floor and extending upward to support said deck above the ocean surface, said space frame structure having a plurality of substantially vertical legs extending from said space frame structure base to said deck, said space frame structure being free from rigid attachment to the ocean floor whereby it is adapted to pivot relative to the ocean floor about said base in response to the action of waves, the combination of said deck and space frame structure having a net negative buoyancy and being free from guylines adapted to provide stabilization against lateral sway;

a plurality of flex piles, each extending upward along a corresponding one of said legs, said flex piles each having a lower end secured to the ocean floor and an upper end rigidly secured to said tower at a pile attachment elevation distal from said ocean floor and below the wave zone of the ocean environment in which said platform is located, said flex piles being free from rigid attachment to said tower below said pile attachment elevation whereby in response to pivoting of said space-frame structure away from a vertical orientation, those flex piles positioned toward the direction of pivoting are compressed and those flex piles positioned away from the direction of pivoting are extended to cause an imbalance in the loading imposed on the piles, this establishing a restoring force acting on said space frame structure at said pile attachment elevation, said restoring force tending to restore said space frame structure to a vertical orientation.

40. The compliant offshore platform as set forth in claim 39 wherein said pile attachment elevation is situated proximate one-half the total height of said tower.

41. A compliant offshore platform, comprising:

a deck;

a substantially rigid, normally vertical space frame structure supporting said deck above the ocean surface, said space frame structure having a plurality of legs extending downward from said deck to a space frame structure base at the ocean floor, said space frame structure being free from rigid attachment to the ocean floor whereby said space frame structure is adapted to pivot about its base in response to waves, said deck and space frame structure having a negative buoyancy and being free from laterally extending guylines;

a plurality of flex piles, each extending upward along a corresponding one of said legs, said flex piles each having a lower end secured to the ocean floor and an upper end fixedly secured to said tower at a pile attachment elevation distal from said ocean floor and below the wave zone of the ocean environment in which said platform is located, said flex piles being secured to said tower in compression whereby said flex piles bear a portion of the weight of said tower and deck, said flex piles being free from rigid attachment to said tower below said pile attachment elevation whereby in response to pivoting of said space-frame structure away from a vertical orientation those flex piles positioned toward the direction of pivoting are placed in increased compression and those flex piles positioned away from the direction of pivoting are placed in decreased compression, whereby a moment is established at said pile attachment elevation in response to pivoting, this moment acting as a restoring force to bias said space frame structure back to a vertical orientation.

42. The compliant offshore platform as set forth in claim 41 wherein said pile attachment elevation is situated proximate one-half the total height of the tower.

* * * * *